US011512696B2

(12) United States Patent
Mantes et al.

(10) Patent No.: US 11,512,696 B2
(45) Date of Patent: Nov. 29, 2022

(54) TRANSFER PUMP

(71) Applicant: Milwaukee Electric Tool Corporation, Brookfield, WI (US)

(72) Inventors: Jonathan M. Mantes, Franklin, WI (US); Jason R. Crowe, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 1031 days.

(21) Appl. No.: 15/402,341

(22) Filed: Jan. 10, 2017

(65) Prior Publication Data

US 2017/0204864 A1 Jul. 20, 2017

Related U.S. Application Data

(60) Provisional application No. 62/279,410, filed on Jan. 15, 2016.

(51) Int. Cl.
*F04C 14/28* (2006.01)
*F04C 5/00* (2006.01)

(52) U.S. Cl.
CPC ..... *F04C 14/28* (2013.01); *F04C 5/00* (2013.01)

(58) Field of Classification Search
CPC ... F04D 7/00; F04D 7/02; F04D 13/00; F04D 13/02; F04D 13/06; F04D 13/068; F04D 13/0686; F04D 13/16; F04D 15/00; F04D 15/0077; F04D 15/02; F04D 15/0209; F04D 15/0218; F04D 15/0236; F04D 15/0245; F04D 15/0254; F04D 15/0263; F04D 29/005; F04C 5/00; F04C 14/28
USPC ..... 417/18, 22, 32, 44.1, 45, 44.11, 63, 417/410.1, 423.1, 423.7, 423.14
See application file for complete search history.

(56) References Cited

U.S. PATENT DOCUMENTS 2,902,935 A * 9/1959 Dinnison ..... F04C 11/001 418/154
3,202,103 A * 8/1965 Sully ..... F04C 5/00 418/179
3,240,154 A * 3/1966 Robbins ..... F04C 14/26 418/135
3,303,791 A * 2/1967 Doble ..... F04C 15/06 416/240
3,467,019 A * 9/1969 Lovatt ..... F04C 15/00 418/154
3,829,248 A * 8/1974 Bright ..... F04C 11/008 417/410.3
D281,609 S 10/1985 Herbst
(Continued)

FOREIGN PATENT DOCUMENTS

EP 2151579 A1 * 2/2010 ..... F04D 15/0254

*Primary Examiner* — Charles G Freay
*Assistant Examiner* — Chirag Jariwala
(74) *Attorney, Agent, or Firm* — Michael Best & Friedrich LLP

(57) ABSTRACT

A transfer pump. The pump is for displacing fluid and may generally include a housing; a pump including an impeller, the pump being disposed within the housing for creating suction to draw the fluid through the impeller; a motor for driving the pump; a battery operable to power the motor; and a sensor for sensing current drawn by the motor. The motor may be deactivated when the current drawn by the motor reaches a predetermined current value for a predetermined amount of time.

17 Claims, 5 Drawing Sheets

(56) References Cited

U.S. PATENT DOCUMENTS 4,589,822 A * 5/1986 Clausen ..... F04D 29/126 277/397
5,549,010 A * 8/1996 Park ..... B01D 29/603 73/861.79
D453,524 S 2/2002 Wu
D466,908 S 12/2002 Poon
6,850,020 B1 * 2/2005 Midas ..... B01F 11/0008 318/286
7,336,044 B1 * 2/2008 Churchett ..... H02P 7/28 318/280
D594,880 S 6/2009 Austen et al.
D621,853 S 8/2010 Sundheim et al.
D650,813 S 12/2011 Varini
D660,320 S 5/2012 Varini
D669,096 S 10/2012 Katsura
D678,339 S 3/2013 Hughes et al.
D700,916 S 3/2014 Kieffer et al.
D707,717 S 6/2014 King
D707,719 S 6/2014 Kamijyo
D725,153 S 3/2015 Berry
D727,363 S 4/2015 Carpenter
8,997,348 B2 * 4/2015 Harvie ..... F04C 5/00 29/888.02
D743,444 S 11/2015 Walsh et al.
D757,825 S 5/2016 Chevallier et al.
D759,123 S 6/2016 Van Dyke et al.
2003/0049134 A1 * 3/2003 Leighton ..... F04D 29/2222 417/40
2003/0062300 A1 * 4/2003 Okano ..... C02F 1/003 210/443
2005/0232796 A1 * 10/2005 Pohler ..... F04B 23/08 417/423.15
2008/0317608 A1 * 12/2008 Gray ..... F04D 15/0209 417/300
2009/0081050 A1 * 3/2009 Moore ..... F04D 15/0209 417/44.11
2014/0021736 A1 * 1/2014 Chenowth ..... B60J 7/085 296/100.11
2016/0333883 A1 * 11/2016 Perrone ..... F04D 13/068
2017/0122325 A1 * 5/2017 Seman, Jr. ..... F04D 15/0066

* cited by examiner

TRANSFER PUMP

CROSS-REFERENCE TO RELATED APPLICATIONS

This application claims priority to prior-filed U.S. Provisional Patent Application No. 62/279,410, filed Jan. 15, 2016, the entire contents of which are incorporated by reference. The present application is also related to U.S. patent application Ser. No. 29/564,812, filed May 16, 2016, the entire contents of which are also incorporated by reference.

FIELD

The invention generally relates to pumps and, more particularly, to transfer pumps for use in transferring fluids at low pressure.

SUMMARY

Transfer pumps are often used to transfer fluids at low pressure. For example, pumps of this type may be used to drain water from a clogged bathtub or another container of liquid. The pumps do not typically generate high pressures but, rather, transfer the liquid smoothly at a low pressure.

In one independent embodiment, a transfer pump for displacing fluid may generally include a housing; a pump including an impeller, the pump being disposed within the housing for creating suction to draw the fluid through the impeller; a motor for driving the pump; a battery operable to power the motor; and a sensor for sensing current drawn by the motor. The motor may be deactivated when the current drawn by the motor reaches a predetermined current value for a predetermined amount of time.

In another independent embodiment, a transfer pump may generally include a housing having an inlet and an outlet; a pump disposed within the housing for creating suction to draw the fluid through the inlet; a motor for driving the pump; a battery operable to power the motor; a sensor for monitoring a pump parameter; and a controller operable to deactivate the motor in response to the pump reaching a predetermined pump parameter.

In yet another independent embodiment, a transfer pump may generally include a housing having an inlet and an outlet; a pump including an impeller, the pump being disposed within the housing for creating suction to draw the fluid through the inlet, the impeller, and out the outlet; a motor for driving the pump; and a viewing window arranged on the housing to provide a view of the impeller.

Other independent aspects of the invention will become apparent by consideration of the detailed description, claims and accompanying drawings.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

The use of "including", "comprising" or "having" and variations thereof herein is meant to encompass the items listed thereafter and equivalents thereof as well as additional items. Unless specified or limited otherwise, the terms "mounted", "connected", "supported" and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
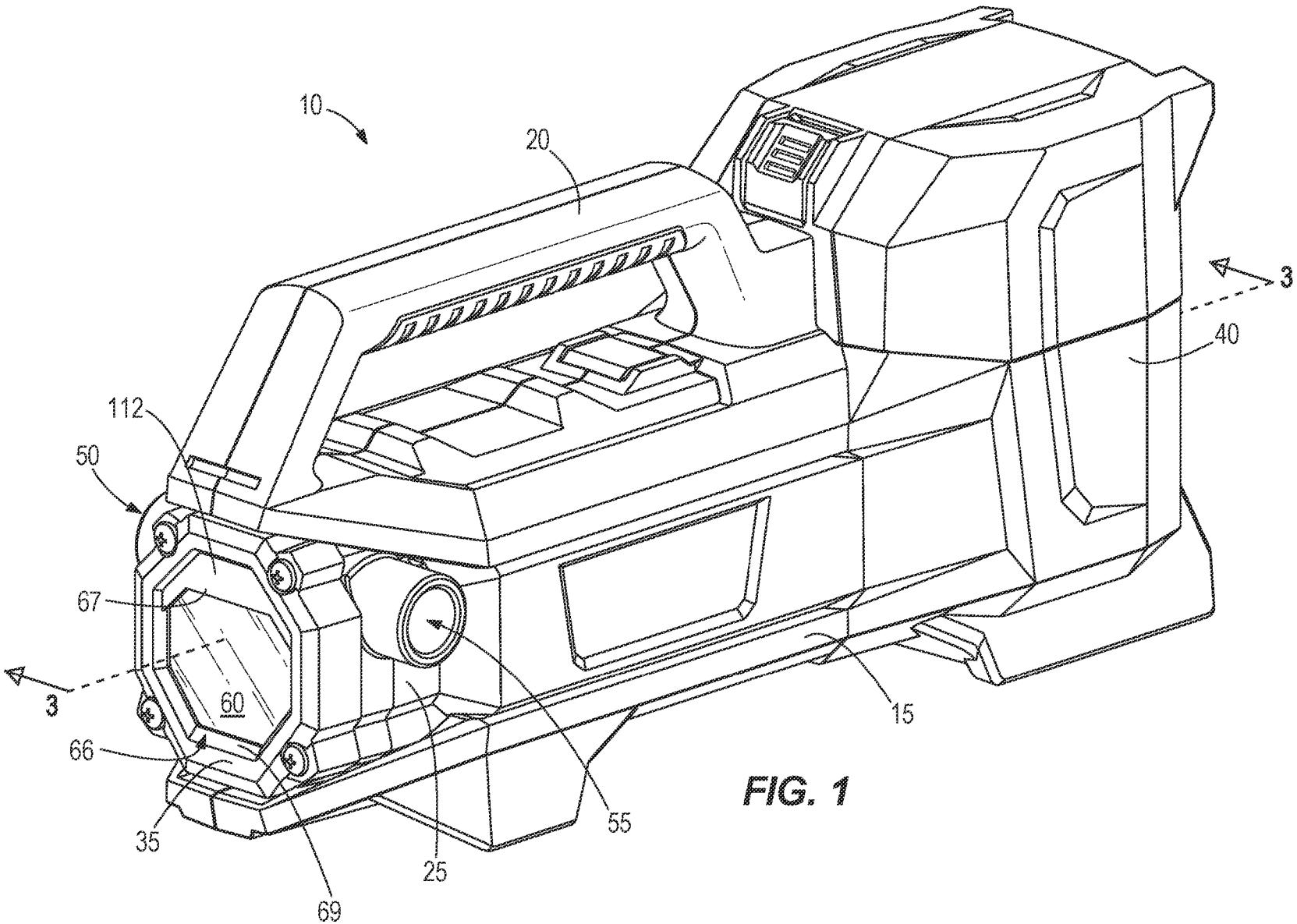
FIG. 1 is a perspective view of a transfer pump.

FIG. 1 illustrates a transfer pump 10 suitable to pump a fluid from a first location (e.g., a clogged bathtub or another container of liquid) to a second location (e.g., a drain, another container, etc.) during a pumping operation. The transfer pump 10 operates at relatively low inlet and outlet pressures with other systems operating at higher pressures.

As shown in FIG. 1, the transfer pump 10 includes a housing 15, a handle 20, a pump 25, a motor 30 (see FIG. 2), an end cap 35, and a power supply. The housing 15 is arranged to enclose or support the pump 25, the motor 30, and the power supply while providing some protection to each of these components.

The handle 20 extends from the housing 15 and provides a convenient way for a user to carry the transfer pump 10. In the illustrated construction, the handle 20 and the housing 15 are formed together as one assembly. The housing 15 and the handle 20 are formed in two halves that define an interior in which the motor 30 and the pump 25 are supported.

In the illustrated construction, the power supply includes a battery pack 40, such as a power tool battery pack that is capable of providing power to the motor 30 as well as to other power tool equipment (e.g., a drill, a saw, etc.). The illustrated battery pack 40 is removable to power another device and for recharging on a battery charger. Alternately or additionally, the battery pack 40 may be rechargeable in place on the transfer pump 10 when connected to a power cord plugged into a power source (e.g., household power (120 volts, 230 volts, etc.)).

The battery pack 40 includes, for example, lithium-based battery cells but could alternatively include battery cells having another chemistry. The battery pack 40 has a nominal voltage of, for example, 18 V. The battery pack 40 may have another nominal battery voltage, such as, for example, 9.6 V, 12 V, 20 V 24 V, etc.

Figure 2:
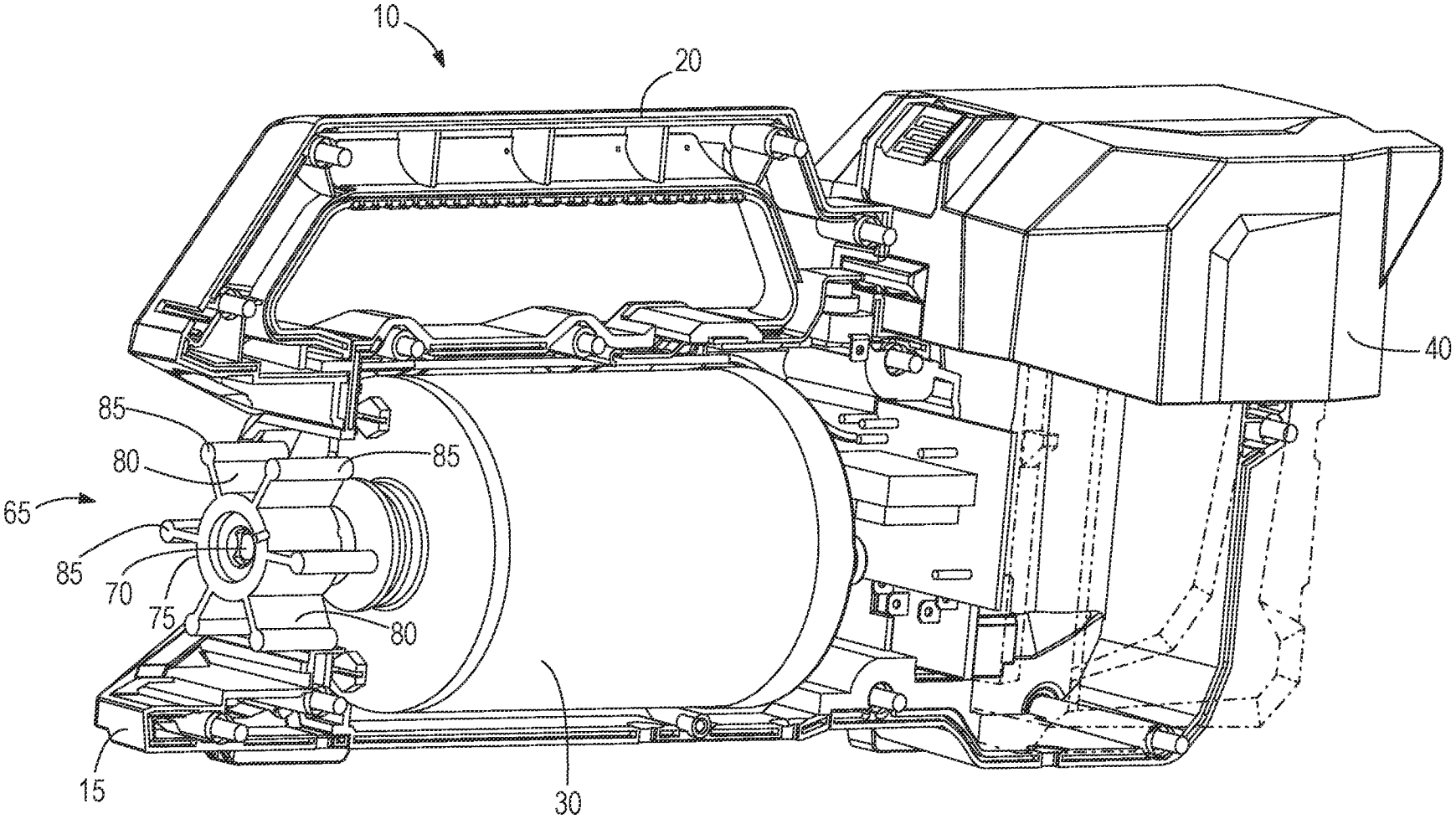
FIG. 2 is a perspective view of the transfer pump of FIG. 1 with a portion of the housing removed.
Figure 3:
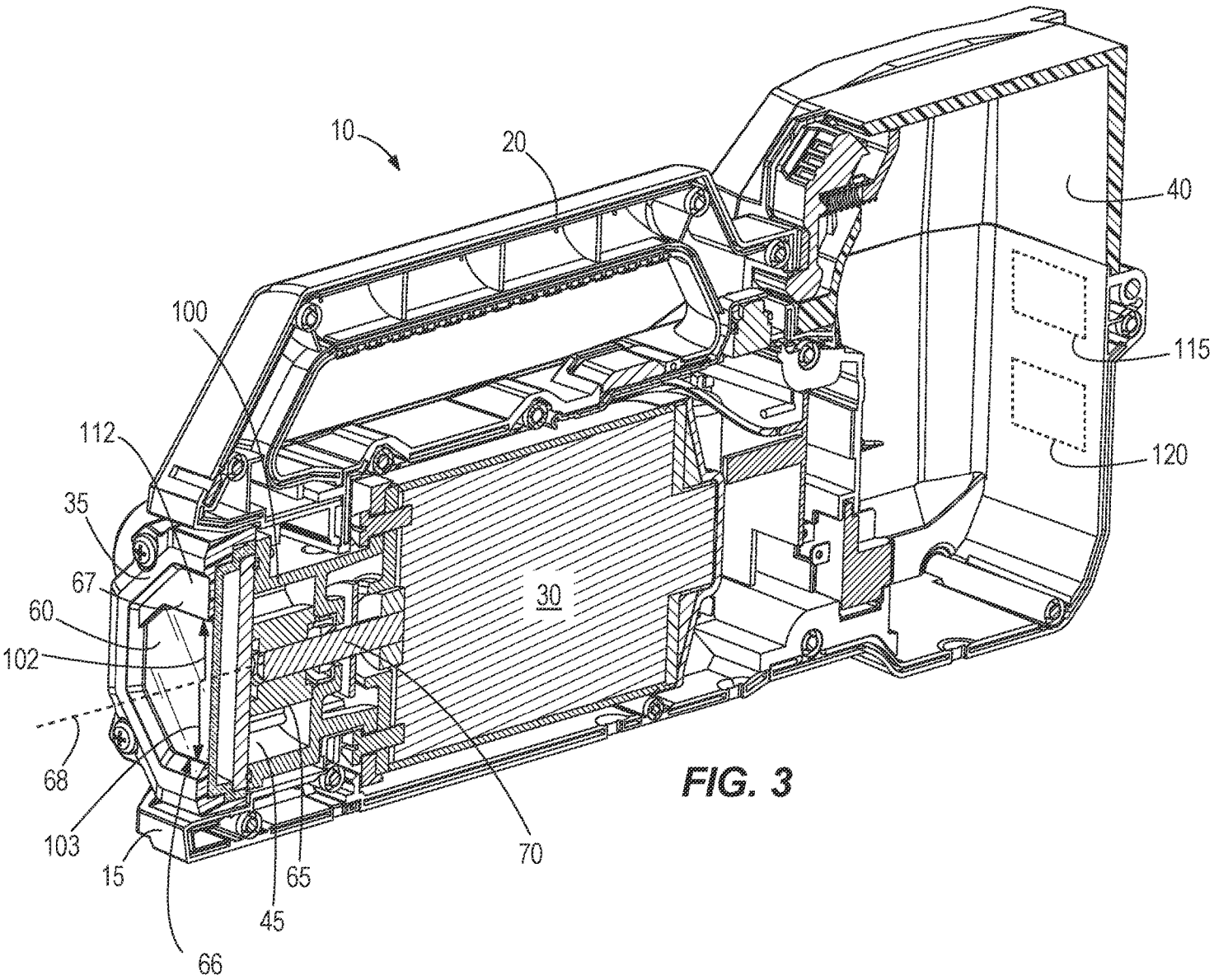
FIG. 3 is a cross-sectional view of the transfer pump taken along line 3-3 in FIG. 1.

With reference to FIGS. 1 and 2, the end cap 35 attaches to the end of the housing 15 adjacent the pump 25 and cooperates with the pump 25 to enclose a pumping chamber 45 (FIG. 4) that includes an inlet 50 and an outlet 55. The end cap 35 includes a front viewing window 60 arranged to provide a view of an impeller 65 of the pump 25. This view allows a user to, for example, evaluate the wear condition of the impeller 65, identify the presence of debris, etc., without disassembling the transfer pump 10 in any way. In the illustrated construction, transparent or translucent plastic is used to form the viewing window 60 with other materials also being suitable. Also, in the illustrated construction, the end cap 35 defines an inner periphery 66 having a reduced radius section 67 that projects radially inwardly toward a drive axis 68 (FIG. 3). The inner periphery 66 of the end cap 35 further includes an enlarged radius section 69 that is disposed circumferentially opposite the reduced radius section 67.

As shown in FIG. 2, the motor 30 includes an output shaft 70 that directly drives the impeller 65 for rotation about the drive axis 68 (FIG. 3). The arrangement of the pump 25 is such that the motor 30 and the impeller 65 can be rotated in either direction to provide for pumping in either direction through the inlet 50 and the outlet 55. That is, the impeller 65 may be rotated in one direction (e.g., clockwise) to draw fluid in through the inlet 50 and discharge fluid out the outlet 55, and may be rotated in the opposite direction (e.g., counterclockwise) to draw fluid in through the outlet 55 and discharge fluid out the inlet 50.

The impeller 65 includes a central hub 75 and a plurality of arms 80 extending radially outwardly from the hub 75. Cylindrical end members 85 are formed at the end of each arm 80. The illustrated impeller 65 is formed from rubber or another flexible material that allows the arms 80 to flex and move significantly (e.g., approximately 10° or more from a radial position) during operation.

Figure 4:
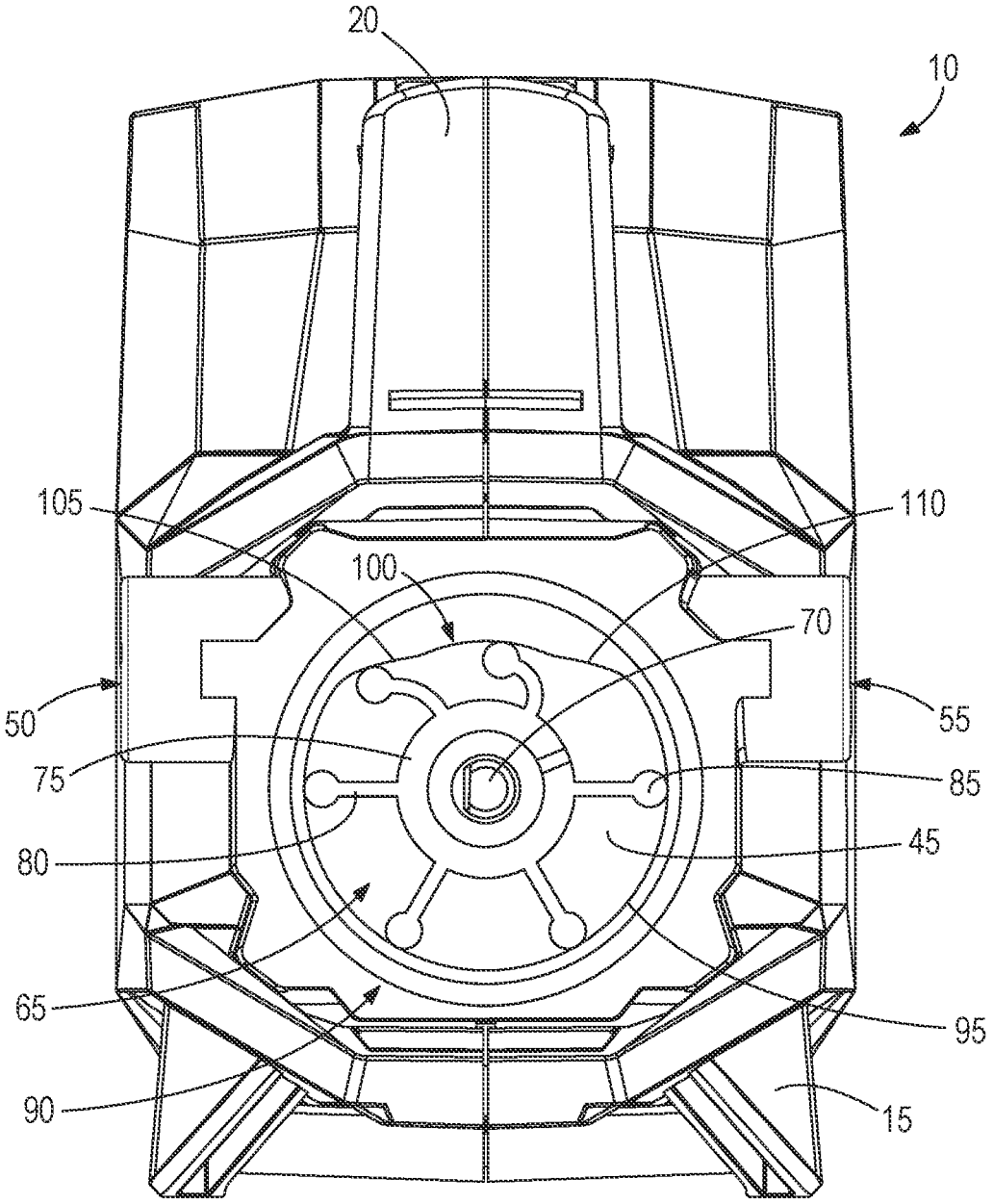
FIG. 4 is an end view of the transfer pump of FIG. 1 with an end cap removed.
Figure 5:
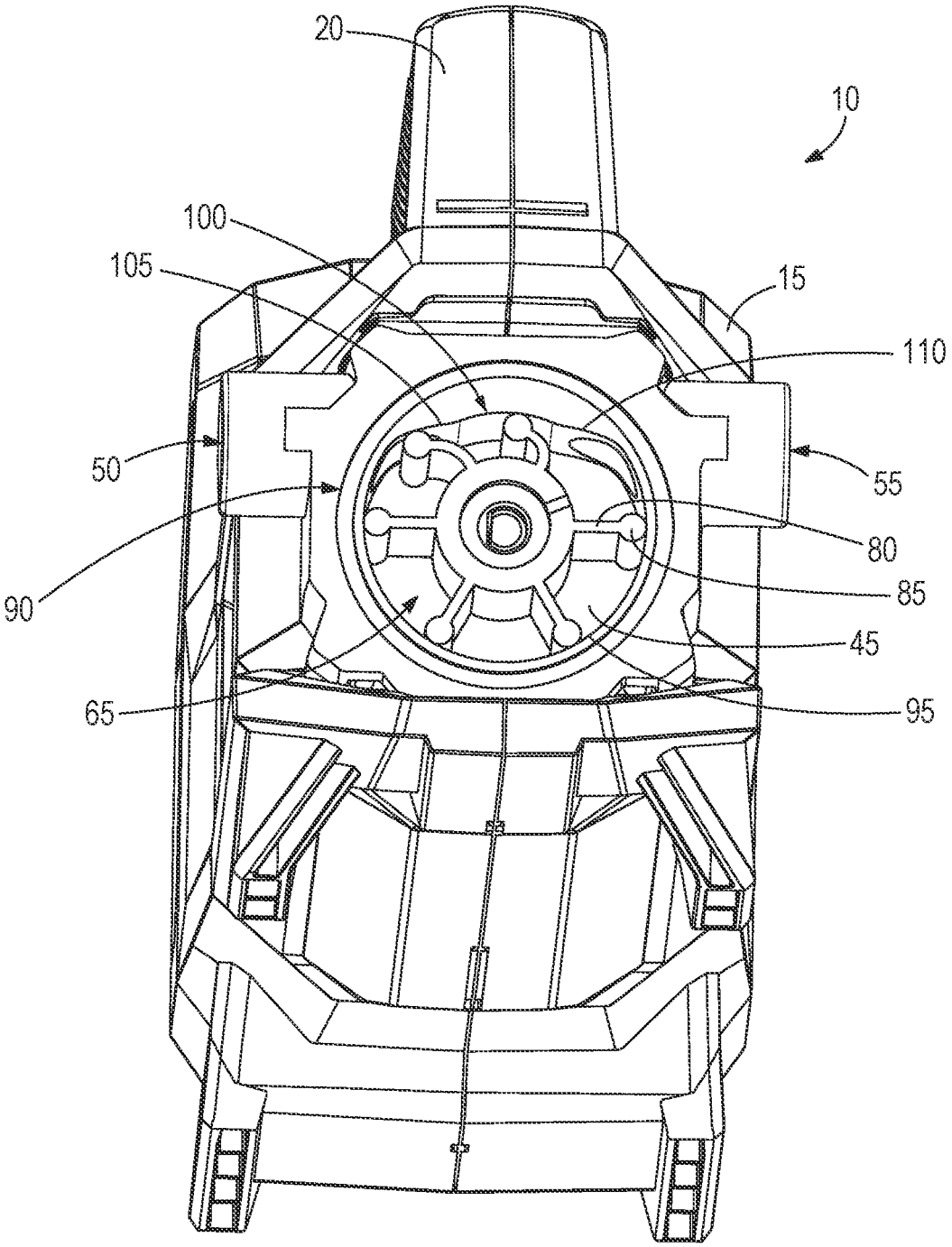
FIG. 5 is another perspective view of the transfer pump of FIG. 1 with the end cap removed.

With reference to FIGS. 4 and 5, the impeller 65 is disposed within a pump housing 90. As shown, the interior of the pump housing 90 is substantially cylindrical. By "substantially", the pump housing 90 includes a cylindrical portion 95 extending, for example, about 260°. The pump housing 90 also includes a flattened portion 100 (e.g., extending about 100°) near top dead center of the pump housing 90. The reduced radius section 67 is oriented along a majority of the flattened portion 100. Furthermore, a first distance 102 is defined from the drive axis 68 to the reduced radius section 67 that extends along a direction from the drive axis 68 to the flattened portion 100. Also, a second distance 103 is defined from the drive axis 68 to the inner periphery 66 that extends along a direction from the drive axis 68 away from the flattened portion 100. The first distance 102 is less than the second distance 103.

The flattened portion 100 includes a first discontinuity 105 adjacent the inlet 50 and a second discontinuity 110 adjacent the outlet 55, both of which facilitate operation of the pump 25. The impeller 65 interferes with the flattened portion 100. As a result, each arm 80 deforms as each cylindrical end members 85 contacts the flattened portion 100. The end cap 35 includes an overhang section 112 covering a portion of the viewing window 60 that is disposed adjacent the flattened portion 100 of the pump housing 90.

With reference to FIG. 3, the transfer pump 10 further includes a sensor 115 for sensing a pump parameter and an electronic processor (for example, a microprocessor or other electronic controller 120) in communication with the sensor 115 and the motor 30. In the illustrated construction, the controller 120 is operable to deactivate the motor 30 in response to the pump 25 reaching a predetermined pump parameter.

In one embodiment, the pump parameter sensed by the sensor 115 includes a temperature. In such a case, the controller 120 is operable to deactivate the motor 30 at a predetermined temperature to, for example, avoid damage to the pump 25, the motor 30, other components of the transfer pump 10.

In the same or a different embodiment, the pump parameter sensed by the sensor 115 may include the current drawn by the motor 30. In such cases, the controller 120 is operable to deactivate the motor 30 when the current drawn by the motor 30 reaches a predetermined current value for a predetermined amount of time. For example, the controller 120 may deactivate the motor 30 when the sensed current reaches approximately 17.5 amperes for the predetermined amount of time of approximately 4 seconds. The controller 120 may deactivate the motor 30 when the sensed current reaches approximately 20 amperes for the predetermined amount of time of approximately 1 second.

In operation, the user connects the inlet 50 to a tube or conduit (not shown) that is placed in a container of fluid (e.g., water) to be transferred. The outlet 55 is connected to a second tube or conduit (not shown) that is placed at the desired output location for the fluid. The battery pack 40 is coupled to the pump 25, the power is turned on, and the direction of rotation (e.g., clockwise, counterclockwise) is selected.

The pump 25 is self-priming and pulls the fluid into the pumping chamber 45. When the impeller 65 is rotating, for example, clockwise (FIG. 4), the fluid is moved toward the outlet 55. At this point, one of the arms 80 contacts the first discontinuity 105 and is deformed toward the adjacent trailing arm 80. This reduces the volume within the pumping chamber 45 and forces the fluid out of the chamber 45.

As the chamber rotates beyond the outlet 55 (i.e., toward the inlet 50), the opposite occurs and the arms 80 separate to create a greater volume and a relatively empty pumping chamber 45. The increased volume produces a reduced pressure and suction that draws additional fluid into the pump 25.

When there is insufficient or no fluid left for the transfer pump 10 to pump, there is more friction between the impeller 65 and the pump housing 90, thereby increasing the load on the motor 30. At this point, the sensor 115 senses the increased current and sends a signal to the controller 120. If the sensed current reaches a predetermined current level, the controller 120 operates to deactivate the transfer pump 10 (e.g., to prevent damage to the components).

As discussed above, in the illustrated construction, the controller 120 is configured to deactivate the motor 30 (1) if the current drawn by the motor 30 is at least 17.5 amperes for at least 4 seconds, or (2) if the current drawn by the motor 30 is at least 20 amperes for at least 1 second. The controller 120 will also deactivate the transfer pump 10 if the temperature detected by the sensor 115 exceeds a predetermined temperature.

The controller 120 includes combinations of hardware and software that are operable to, among other things, configure and control operation of the transfer pump 10. The controller 120 includes a processing unit (e.g., a microprocessor, a microcontroller, or another suitable programmable device), non-transitory computer-readable media, and an input/output interface. The processing unit, the media, and the input/output interface are connected by one or more control and/or data buses.

The computer-readable media stores program instructions and data. The processing unit is configured to retrieve instructions from the media and execute the instructions to perform the control processes and methods described herein. The input/output interface transmits data from the controller 120 to external systems, networks, and/or devices and receives data from external systems, networks, and/or devices. The input/output interface stores data received from external sources to the media and/or provides the data to the processing unit.

Many of the modules and logical structures described are capable of being implemented in software executed by a microprocessor or a similar device or of being implemented in hardware using a variety of components including, for example, application specific integrated circuits ("ASICs"). Terms like "controller" and "module" may include or refer to both hardware and/or software. Capitalized terms conform to common practices and help correlate the description with the coding examples, equations, and/or drawings. However, no specific meaning is implied or should be inferred simply due to the use of capitalization. Thus, the claims should not be limited to the specific examples or terminology or to any specific hardware or software implementation or combination of software or hardware.

Although the invention has been described in detail with reference to certain preferred embodiments, variations and modifications exist within the scope and spirit of one or more independent aspects as described.

One or more independent features and/or independent advantages of the invention may be set forth in the following claims:

What is claimed is:

1. A transfer pump for displacing fluid, the pump comprising:

a housing having an inlet and an outlet;

a pump including an impeller with a central hub and a plurality of arms that extend radially outward from the central hub, the pump being disposed within the housing for creating suction to draw the fluid through the inlet, the impeller, and out the outlet;

a pump casing surrounding the pump and including a flattened portion projecting radially inwardly toward the impeller, wherein the flattened portion is disposed adjacent at least one of the inlet or the outlet, wherein the plurality of arms are deformable in response to contacting the flattened portion;

a motor for driving the impeller about a drive axis;

a battery operable to power the motor;

a viewing window arranged on the housing to provide a view of the plurality of arms of the impeller, such that debris between adjacent arms is viewable without any disassembly of the pump; and an end cap coupled to the housing to support the viewing window adjacent the pump, the end cap defining an inner periphery having a reduced radius section that projects radially inwardly toward the drive axis, wherein the reduced radius section is oriented along a majority of the flattened portion.

2. The pump of claim 1, wherein the impeller further includes cylindrical end members formed at an end of each arm of the plurality of arms of the impeller.

3. The pump of claim 1, wherein an interior of the pump casing is generally cylindrical with the flattened portion extending radially inwardly toward the drive axis, and wherein the reduced radius section of the end cap inhibits viewing of at least a portion of the flattened portion when viewed in a direction along the drive axis.

4. The pump of claim 1, further comprising a first distance defined from the drive axis to the reduced radius section that extends along a direction from the drive axis to the flattened portion, and a second distance defined from the drive axis to the inner periphery that extends along a direction from the drive axis away from the flattened portion, and wherein the first distance is less than the second distance.

5. The pump of claim 1, wherein the reduced radius section overlaps the flattened portion in a direction along the drive axis.

6. The pump of claim 1, wherein the inner periphery of the end cap further includes an enlarged radius section that is disposed circumferentially opposite the reduced radius section.

7. The pump of claim 1, wherein the end cap is coupled to the housing via a plurality of fasteners.

8. The pump of claim 1, wherein the end cap is opaque.

9. The pump of claim 1, wherein the impeller is composed of a flexible material that allows the impeller to flex and move significantly during operation.

10. The pump of claim 9, wherein the impeller is composed of a rubber material.

11. The pump of claim 1, wherein the flattened portion includes a first discontinuity projecting radially inwardly toward the drive axis proximate the inlet and a second discontinuity projecting radially inwardly toward the drive axis proximate the outlet.

12. The pump of claim 11, wherein the plurality of arms are deformable in response to contacting the first discontinuity and the second discontinuity.

13. A transfer pump for displacing fluid, the pump comprising:

a housing having an inlet and an outlet;

a pump including an impeller with a central hub and a plurality of arms that extend radially outward from the central hub, the pump being disposed within the housing for creating suction to draw the fluid through the inlet, the impeller, and out the outlet, the impeller configured to rotate about a drive axis;

a pump casing surrounding the pump, the pump casing including a radially inward wall extending nearer the drive axis than a remainder of the pump casing, the radially inward wall disposed at least partially between the inlet and the outlet of the pump;

a viewing window arranged on the housing to provide a view of the plurality of arms of the impeller; and an end cap coupled to the housing, the end cap trapping the viewing window between the end cap and the pump casing, the end cap including an overhang section covering a portion of the viewing window that is disposed adjacent the radially inward wall of the pump casing.

14. The pump of claim 13, wherein the radially inward wall faces the drive axis.

15. The pump of claim 13, wherein each of the inlet and the outlet is defined at least partially in the radially inward wall.

16. The pump of claim 13, wherein the pump casing is a continuous part about the pump, such that the plurality of arms contact the pump casing throughout rotation about the drive axis.

17. The pump of claim 13, wherein the pump casing defines a cross-section of a pumping chamber generally having a shape of a circle with a discontinuity that interrupts the shape of the circle, the cross-section lying in a plane that is perpendicular to the drive axis.

* * * * *